United States Patent [19]

Swan et al.

[11] Patent Number: 5,064,558

[45] Date of Patent: Nov. 12, 1991

[54] AZEOTROPE-LIKE COMPOSITIONS OF 1,1,2-TRI-CHLORO-1,2,2-TRIFLUOROETHANE, 1,2-DICHLOROETHYLENE, CYCLOPENTANE, METHANOL, NITROMETHANE AND OPTIONALLY DIISOPROPYLAMINE

[75] Inventors: Ellen L. Swan, Ransomville; Leonard M. Stachura, Hamburg; Rajat S. Basu; David P. Wilson, both of Williamsville, all of N.Y.

[73] Assignee: Allied-Signal Inc., Morris Township, Morris County, N.J.

[21] Appl. No.: 546,464

[22] Filed: Jun. 25, 1990

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 203/67; 252/153; 252/162; 252/170; 252/364; 252/544; 252/DIG. 9

[58] Field of Search ..... 252/162, 170, 171, 172, 252/364, DIG. 9, 153, 544; 203/67; 134/12, 38, 39, 40

[56] References Cited

U.S. PATENT DOCUMENTS

| | | | |
|---|---|---|---|
| 4,279,665 | 7/1981 | Colbert et al. | 252/171 |
| 4,476,036 | 10/1984 | Figiel et al. | 252/171 |
| 4,767,561 | 8/1988 | Gorski | 252/171 |
| 4,803,009 | 2/1989 | Gorski | 252/171 |
| 4,808,331 | 2/1989 | Burt et al. | 252/172 |
| 4,904,407 | 2/1990 | Swan et al. | 252/171 |
| 4,973,362 | 11/1990 | Magid et al. | 252/171 |
| 4,973,421 | 11/1990 | Tamura et al. | 252/171 |

FOREIGN PATENT DOCUMENTS

| | | |
|---|---|---|
| 2-135290 | 5/1990 | Japan . |

*Primary Examiner*—Paul Lieberman
*Assistant Examiner*—Linda Skaling
*Attorney, Agent, or Firm*—Colleen D. Szuch; Jay P. Friedenson

[57] ABSTRACT

Stable azeotrope-like compositions consisting essentially of 1,1,2-trichloro-1,2,2-trifluoroethane, 1,2-dichloroethylene, cyclopentane, methanol, nitromethane, and optionally diisopropylamine which are useful in a variety of industrial cleaning applications.

27 Claims, No Drawings

AZEOTROPE-LIKE COMPOSITIONS OF 1,1,2-TRI-CHLORO-1,2,2-TRIFLUOROETHANE, 1,2-DICHLOROETHYLENE, CYCLOPENTANE, METHANOL, NITROMETHANE AND OPTIONALLY DIISOPROPYLAMINE

FIELD OF THE INVENTION

This invention relates to azeotrope-like mixtures of 1,1,2-trichloro-1,2,2-trifluoroethane, 1,2-dichloroethylene, cyclopentane, methanol, nitromethane and optionally diisopropylamine. These mixtures are useful in a variety of vapor degreasing, cold cleaning and solvent cleaning applications including defluxing of printed circuit boards.

CROSS-REFERENCE TO RELATED APPLICATION

U.S. patent application Ser. No. 07/542,842 filed June 25, 1990, discloses azeotrope-like compositions of 1,1,2-trichloro-1,2,2-trifluoroethane, 1,2-dichloroethylene, cyclopentane and nitromethane.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contaminants. Final evaporation of solvent from the object leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al., in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications the soiled part is either immersed in the fluid or wiped with cloths soaked in solvents and allowed to air dry.

Recently, nontoxic, nonflammable fluorocarbon solvents liks trichlorotrifluoroethane have been used extensively in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions having fluorocarbon components because the fluorocarbon components contribute additionally desired characteristics, such as polar functionality, increased solvency power, and stabilizers. Azeotropic compositions are desired because they do not fractionate upon boiling. This behavior is desirable because, in the previously described vapor degreasing equipment with which these solvents are employed, redistilled material is generated for final rinse-cleaning. Thus, the vapor degreasing system acts as a still. Therefore, unless the solvent composition is essentially constant boiling, fractionation will occur and undesirable solvent distribution may act to upset the cleaning and safety of processing. For example, preferential evaporation of the more volatile components of the solvent mixtures, would result in mixtures with changed compositions which may have less desirable properties, such as lower solvency towards soils, less inertness towards metal, plastic or elastomer components, and increased flammability and toxicity.

A number of 1,1,2-trichloro-1,2,2-trifluoroethane-based azeotrope compositions have been discovered, tested and in some cases employed as solvents for miscellaneous vapor degreasing and defluxing applications. For example, U.S. Pat. No. 3,573,213 discloses the azeotrope of 1,1,2-trichloro-1,2,2-trifluoroethane and nitromethane; U.S. Pat. No. 2,999,816 discloses an azeotropic composition of 1,1,2-trichloro-1,2,2-trifluoroethane and methyl alcohol; U.S. Pat. No. 3,960,746 discloses azeotrope-like compositions of 1,1,2-trichloro-1,2,2-trifluoroethane, methanol and nitromethane; U.S. Pat. No. 3,455,835 discloses azeotrope-like compositions of 1,1,2-trichloro-1,2,2-trifluoroethane and trans-1,2-dichloroethylene; U.S. Patent 4,767,561 discloses azeotrope-like compositions containing 1,1,2-trichloro-1,2,2-trifluoroethane, methanol and trans-1,2-dichloroethylene; U.S. Pat. No. 4,808,331 discloses azeotrope-like compositions of 1,1,2-trichloro-1,2,2-trifluoroethane, trans-1,2-dichloroethylene and cyclopentane; and U.S. Pat. No. 4,877,545 discloses azeotrope-like compositions of 1,1,2-trichloro-1,2,2-trifluoroethane, ethanol, isopropanol, trans-1,2-dichloroethylene, acetone and hexane.

The art is continually seeking new fluorocarbon-based azeotropic mixtures or azeotrope-like mixtures which offer alternatives for new and special vapor degreasing and other cleaning applications.

Accordingly it is an object of this invention to provide novel azeotrope-like compositions based on trichlorotrifluoroethane which have good solvency power and other desirable properties for vapor degreasing and other solvent cleaning applications.

It is another object of this invention to provide azeotrope-like compositions which are liquid at room temperature and which will not fractionate under conditions of use.

A further object of this invention is to provide azeotrope-like compositions which are nonflammable in both the liquid and vapor phases.

Other objects and advantages of this invention will become apparent from the following description.

SUMMARY OF THE INVENTION

The invention relates to novel azeotrope-like compositions of 1,1,2-trichloro-1,2,2-trifluoroethane, 1,2-dichloroethylene, cyclopentane, methanol, nitromethane and optionally diisopropylamine which are useful in a variety of industrial cleaning applications.

DETAILED DESCRIPTION OF THE INVENTION

In accordance with the invention, novel azeotrope-like compositions have been discovered comprising from about 50.3 to about 78 weight percent 1,1,2-trichloro-1,2,2-trifluoroethane, from about 14 to about 27 weight percent 1,2-dichloroethylene, from about 3 to about 16 weight percent cyclopentane, from about 5 to about 6.2 weight percent methanol, from about 0.05 to about 0.5 weight percent nitromethane and optionally from about 0 to about 2 weight percent diisopropylamine which boil at about 38.1° C. ± about 0.5° C. at 760 mm Hg.

Trichlorotrifluoroethane exists in two isomeric forms, 1,1,2-trichloro-1,2,2-trifluoroethane (CFC-113) and 1,1,1-trichloro-1,2,2-trifluoroethane (CFC-113a). However, for purposes of this invention, trichlorotrifluoroethane will refer only to the CFC-113 isomer.

1,2-Dichloroethylene also exists in two isomeric forms, trans-1,2-dichloroethylene and cis-1,2-dichloroethylene. Each isomer forms azeotrope-like compositions with 1,1,2-trichloro-1,2,2-trifluoroethane, cyclopentane, methanol, nitromethane and optionally diisopropylamine in accordance with the invention. Similarly, mixtures of the trans- and cisisomers also form azeotrope-like compositions with these components. The trans- isomer, however, is the preferred 1,2-dichloroethylene isomer in accordance with the invention. Commercial trans-1,2-dichloroethylene is often provided as a mixture containing from about 5 to about 30 weight percent cis-1,2-dichloroethylene.

Trichlorotrifluoroethane has good solvent Properties. Cyclopentane, methanol and 1,2-dichloroethylene are also good solvents. Cyclopentane and 1,2-dichloroethylene enhance the solubility of oils while methanol dissolves polar organic materials and amine hydrochlorides. Nitromethane is a known stabilizer. Thus, when these components are combined in effective amounts, a stable, efficient azeotrope-like solvent results.

Preferably, the azeotrope-like compositions of the invention consist essentially of from about 51.3 to about 76.7 weight percent 1,1,2-trichloro-1,2,2-trifluoroethane, from about 15 to about 26 weight percent 1,2-dichloroethylene, from about 3 to about 16 weight percent cyclopentane, from about 5.3 to about 6.2 weight percent methanol and from about 0.05 to about 0.5 weight percent nitromethane and boil at about 38.1° C. ± about 0.4° C. at 760 mm Hg.

In a more preferred embodiment of the invention, the azeotrope-like compositions of the invention consist essentially of from about 54.2 to about 73 weight percent 1,1,2-trichloro-1,2,2-trifluoroethane, from about 17 to about 24 weight percent 1,2-dichloroethylene, from about 4.5 to about 15.5 weight percent cyclopentane, from about 5.5 to about 5.9 weight percent methanol and from about 0.05 to about 0.4 weight percent nitromethane.

When diisopropylamine is added, the azeotrope-like compositions of the invention consist essentially of from about 49.8 to about 76.6 weight percent 1,1,2-trichloro-1,2,2-trifluoroethane, from about 15 to about 26 weight percent 1,2-dichloroethylene, from about 3 to about 16 weight percent cyclopentane, from about 5.3 to about 6.2 weight percent methanol, from about 0.05 to about 0.5 weight percent nitromethane and from about 0.02 to about 2 weight percent diisopropylamine and boil at about 38.1° C. ± about 0.4° C. at 760 mm Hg.

In a more preferred embodiment of the invention utilizing diisopropylamine, the azeotrope-like compositions of the invention consist essentially of from about 53.7 to about 73 weight percent 1,1,2-trichloro-1,2,2-trifluoroethane, from about 17 to about 24 weight percent 1,2-dichloroethylene, from about 4.5 to about 15.5 weight percent cyclopentane, from about 5.5 to about 5.9 weight percent methanol, from about 0 05 to about 0.4 weight percent nitromethane and from about 0.02 to about 0.5 weight percent diisopropylamine.

It is known in the art that the use of more active solvents, such as lower alkanols in combination with certain halocarbons such as trichlorotrifluoroethane, may have the undesirable result of attacking reactive metals such as zinc and aluminum, as well as certain aluminum alloys and chromate coatings such as are commonly employed in circuit board assemblies. The art has recognized that certain stabilizers, like nitromethane, are effective in preventing metal attack by chlorofluorocarbon mixtures with such alkanols. Other candidate stabilizers for this purpose, such as disclosed in the literature, are secondary and tertiary amines, olefins and cycloolefins, alkylene oxides, sulfoxides, sulfones, nitrites and nitriles, and acetylenic alcohols or ethers. It is contemplated that such stabilizers as well as other additives may be combined with the azeotrope-like compositions of this invention.

The precise azeotrope compositions in accordance with the invention have not been determined but have been ascertained to be within the above ranges. Regardless of where the true azeotrope lie, all compositions within the indicated ranges, as well as certain compositions outside the indicated ranges, are azeotrope-like, as defined more particularly below.

These azeotrope-like compositions are stable, safe to use and the preferred compositions of the invention are nonflammable (exhibit no flash point when tested by the Tag Open Cup test method—ASTM D 1310-86) and exhibit excellent solvency power. These compositions are particularly effective when employed in conventional degreasing units for the dissolution of rosin fluxes and the cleaning of such fluxes from printed circuit boards.

From fundamental principles, the thermodynamic state of a system (pure fluid or mixture) is defined by four variables: pressure, temperature, liquid composition and vapor composition, or P-T-X-Y, respectively. An azeotrope is a unique characteristic of a system of two or more components where X and Y are equal at a stated P and T. In practice, this means that the components of a mixture cannot be separated during distillation or in vapor phase solvent cleaning when that distillation is carried out at a fixed T (the boiling point of the mixture) and a fixed P (atmospheric pressure).

For purposes of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only minimally. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its components. If the mixture is non-azeotropic or non-azeotrope-like, the mixture will fractionate, i.e., separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above discussion that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly and changes in distillation pressures also change, at least slightly, the distillation temperatures. Thus, an azeotrope of A and B represents a unique type of relationship having a variable composition depending on temperature and/or pressure. Accordingly, another way of defining azeotrope-like within the meaning of this invention is to state that such mixtures boil within about ±0.5° C. of the boiling point of the most preferred compositions disclosed herein.

In the process embodiment of the invention, the azeotrope-like compositions of the invention may be used to clean solid surfaces by treating said surfaces with said compositions in any manner well known in the art such as by dipping or spraying or use of conventional degreasing apparatus.

The 1,1,2-trichloro-1,2,2-trifluoroethane, 1,2-dichloroethylene, cyclopentane, methanol, nitromethane, and diisopropylamine components of the invention are known materials. Preferably they should be used in sufficiently high purity so as to avoid the introduction of adverse influences upon the solvency properties or constant boiling properties of the system. A suitable grade of CFC-113, for example, is sold by Allied-Signal Inc. under the trademark GENESOLV D.

EXAMPLES 1-2

The azeotrope-like compositions of the invention were determined through the use of distillation techniques designed to provide higher rectification of the distillate than found in most vapor degreaser systems. For this purpose, a five theoretical plate Oldershaw distillation column with a cold water condensed, manual liquid dividing head was used. Typically, approximately 350 grams of liquid were charged to the distillation pot. The liquid was a mixture comprised of various combinations of 1,1,2-trichloro-1,2,2-trifluoroethane (FC-113), trans-1,2-dichloroethylene (TDCE), cyclopentane (CP), methanol (MeOH) and nitromethane (NM) with and without diisopropylamine.

The mixtures were heated at total reflux for about one hour to ensure equilibration. For most of the runs, the distillate was obtained using a 3:1 reflux ratio at a boil-up rate of 250–300 grams per hour. Approximately 150 grams of product were distilled and 4 approximately equivalent sized overhead cuts were collected. The vapor temperature (of the distillate), pot temperature, and barometric pressure were monitored. A constant boiling fraction was collected and analyzed by gas chromatography to determine the weight percentages of its components.

To normalize observed boiling points during different days to 760 mm of mercury pressure, the approximate normal boiling points of CFC-113 rich mixtures were estimated by applying a barometric correction factor of about 26 mm Hg/°C., to the observed values. However, it is to be noted that this corrected boiling point is generally accurate up to ±0.4° C. and serves only as a rough comparison of boiling points determined on different days.

Supporting distillation data for the mixtures studied are shown in TABLE I.

TABLE I

| | STARTING MATERIAL (WT %) | | | | | |
|---|---|---|---|---|---|---|
| Example | FC-113 | MeOH | TDCE | CP | NM | Diisopropyl amine |
| 1 | 61.0 | 5.7 | 18.0 | 15.1 | 0.3 | — |
| 2 | 65.0 | 5.8 | 24.6 | 4.2 | 0.1 | 0.2 |

| | DISTILLATE MATERIAL (WT %) | | | | | |
|---|---|---|---|---|---|---|
| Example | FC-113 | MeOH | TDCE | CP | NM | Diisopropyl amine |
| 1 | 59.2 | 5.9 | 17.4 | 15.3 | 0.1 | — |
| 2 | 64.2 | 6.0 | 24.7 | 5.0 | 0.05 | 0.1 |

| Example | Boiling Point | Barometric Pressure | Boiling Point (corrected to 760 mm Hg) |
|---|---|---|---|
| 1 | 36.9 | 734 | 37.9 |
| 2 | 37.8 | 747 | 38.3 |
| | | | 38.1° C. ± 0.2° C. |

EXAMPLE 3-4

The azeotropic properties of 1,1,2-trichloro-1,2,2-trifluoroethane, methanol, commercial trans-1,2-dichloroethylene, cyclopentane and nitromethane with and without diisopropylamine are studies by repeating the experiment outlined in Examples 1–2 above except that commercial trans-1,2-dichloroethylene is substituted for trans-1,2-dichloroethylene. In each case a minimum in the boiling point versus composition curve occurs indicating that a constant boiling composition forms between 1,1,2-trichloro-1,2,2-trifluoroethane, methanol, commercial trans-1,2-dichloroethylene, cyclopentane and nitromethane with and without diisopropylamine.

EXAMPLES 5-6

The azeotropic properties of 1,1,2-trichloro-1,2,2-trifluoroethane, methanol, a mixture of trans- and cis-1,2-dichloroethylene, cyclopentane and nitromethane with and without diisopropylamine are studied by repeating the experiment outlined in Examples 1–2 above except that a mixture of trans- and cis-1,2-dichloroethylene is substituted for trans-1,2-dichloroethylene. In each case a minimum in the boiling point versus composition curve occurs indicating that a constant boiling composition forms between 1,1,2-trichloro-1,2,2-trifluoroethane, methanol, a mixture of trans- and cis-1,2-dichloroethylene, cyclopentane and nitromethane with and without diisopropylamine.

EXAMPLES 7-10

Performance studies are conducted to evaluate the solvent properties of the azeotrope-like compositions of the invention. Specifically, metal coupons are cleaned using the azeotrope-like composition of Example 1 as solvent (this experiment is repeated using the azeotrope-like compositions of Examples 2-6). The metal coupons are soiled with various types of oils and heated to 93° C. so as to partially simulate the temperature attained while machining and grinding in the presence of these oils.

The metal coupons thus treated are degreased in a simulated vapor phase degreaser. Condenser coils are kept around the lip of a cylindrical vessel to condense the solvent vapor which then collects in the vessel. The metal coupons are held in the solvent vapor and rinsed for a period of 15 seconds to 2 minutes depending upon the oils selected.

The cleaning performance of the azeotrope-like compositions is determined by visual observation and by measuring the weight change of the coupons using an analytical balance to determine the total residual materials left after cleaning. The results indicate that the compositions of the invention are effective solvents.

What is claimed is:

1. Azeotrope-like compositions consisting essentially of from about 50.3 to about 78 weight percent 1,1,2-trichloro-1,2,2-trifluoroethane, from about 14 to about 27 weight percent 1,2-dichloroethylene selected from the group consisting of trans-1,2-dichloroethylene and a mixture of trans-1,2-dichloroethylene and cis-1,2-dichloroethylene wherein said cis-1,2-dichloroethylene is present in an amount from about 5 to about 30 weight percent of said mixture, from about 5 to about 6.2 weight percent methanol, from about 3 to about 16 weight percent cyclopentane, from about 0.05 to about 0.5 weight percent nitromethane and from about 0 to about 2 weight percent diisopropylamine which boil at about 38.1° C. at 760 mm Hg.

2. The azeotrope-like compositions of claim 1 wherein said compositions boil at about 38.1° C. ±0.5° C. at 760 mm Hg.

3. Azeotrope-like compositions consisting essentially of from about 51.3 to about 76.7 weight percent 1,1,2-trichloro-1,2,2-trifluoroethane, from about 15 to about 26 weight percent 1,2-dichloroethylene selected from the group consisting of trans-1,2-dichloroethylene and a mixture of trans-1,2-dichloroethylene and cis-1,2-dichloroethylene wherein said cis-1,2-dichloroethylene is present in an amount from about 5 to about 30 weight percent of said mixture, from about 5.3 to about 6.2 weight percent methanol, from about 3 to about 16 weight percent cyclopentane and from about 0.05 to about 0.5 weight percent nitromethane which boil at about 38.1° C. at 760 mm Hg.

4. The azeotrope-like compositions of claim 3 wherein said compositions boil at about 38.1° C. ±0.4° C. at 760 mm Hg.

5. The azeotrope-like compositions of claim 3 wherein said compositions consist essentially of from about 54.2 to about 73 weight percent 1,1,2-trichloro-1,2,2-trifluoro-ethane, from about 17 to about 24 weight percent 1,2-dichloroethylene, from about 5.5 to about 5.9 weight percent methanol, from about 4.5 to about 15.5 weight percent cyclopentane and from about 0.05 to about 0.4 weight percent nitromethane.

6. Azeotrope-like compositions consisting essentially of from about 49.8 to about 76.6 weight percent 1,1,2-trichloro-1,2,2-trifluoroethane, from about 15 to about 26 weight percent 1,2-dichloroethylene selected from the group consisting of trans-1,2-dichloroethylene and a mixture of trans-1,2-dichloroethylene and cis-1,2-dichloroethylene wherein said cis-1,2-dichloroethylene is present in an amount from about 5 to about 30 weight percent of said mixture, from about 5.3 to about 6.2 weight percent methanol, from about 3 to about 16 weight percent cyclopentane, from about 0.05 to about 0.5 weight percent nitromethane and from about 0.02 to about 2 weight percent diisopropylamine which boil at about 38.1° C. at 760 mm Hg.

7. The azeotrope-like compositions of claim 6 wherein said compositions boil at about 38.1° C. ±0.4° C. at 760 mm Hg.

8. The azeotrope-like compositions of claim 6 wherein said compositions consist essentially of from about 53.7 to about 73 weight percent 1,1,2-trichloro-1,2,2-trifluoro-ethane, from about 17 to about 24 weight percent 1,2-dichloroethylene, from about 5.5 to about 5.9 weight percent methanol, from about 4.5 to about 15.5 weight percent cyclopentane, from about 0.05 to about 0.4 weight percent nitromethane and from about 0.02 to about 0.5 weight percent diisopropylamine.

9. The azeotrope-like compositions of claim 1 wherein said 1,2-dichloroethylene is trans-1,2-dichloroethylene.

10. The azeotrope-like compositions of claim 3 wherein said 1,2-dichloroethylene is trans-1,2-dichloroethylene.

11. The azeotrope-like compositions of claim 5 wherein said 1,2-dichloroethylene is trans-1,2-dichloroethylene.

12. The azeotrope-like compositions of claim 6 wherein said 1,2-dichloroethylene is trans-1,2-dichloroethylene.

13. The azeotrope-like compositions of claim 8 wherein said 1,2-dichloroethylene is trans-1,2-dichloroethylene.

14. The azeotrope-like compositions of claim 1 wherein said 1,2-dichloroethylene is a mixture of trans-1,2-dichloroethylene and cis-1,2-dichloroethylene.

15. The azeotrope-like compositions of claim 3 wherein said 1,2-dichloroethylene is a mixture of trans-1,2-dichloroethylene and cis-1,2-dichloroethylene.

16. The azeotrope-like compositions of claim 5 wherein said 1,2-dichloroethylene is a mixture of trans-1,2-dichloroethylene and cis-1,2-dichloroethylene.

17. The azeotrope-like compositions of claim 6 wherein said 1,2-dichloroethylene is a mixture of trans-1,2-dichloroethylene and cis-1,2-dichloroethylene.

18. The azeotrope-like compositions of claim 8 wherein said 1,2-dichloroethylene is a mixture of trans-1,2-dichloroethylene and cis-1,2-dichloroethylene.

19. The azeotrope-like compositions of claim 1 wherein an effective amount of a stabilizer other than nitromethane and diisopropylamine is present in said compositions.

20. The azeotrope-like compositions of claim 3 wherein an effective amount of a stabilizer other than nitromethane and diisopropylamine is present in said compositions.

21. The azeotrope-like compositions of claim 6 wherein an effective amount of a stabilizer is other than nitromethane and diisopropylamine is present in said compositions.

22. The azeotrope-like compositions of claim 19 wherein said stabilizer is selected from the group consisting of secondary and tertiary amines, olefins and cycloolefins, alkylene oxides, sulfoxides, sulfones, nitrites, nitriles and acetylenic alcohols or ethers.

23. The azeotrope-like compositions of claim 20 wherein said stabilizer is selected from the group consisting of secondary and tertiary amines, olefins and cycloolefins, alkylene oxides, sulfoxides, sulfones, nitrites, nitriles and acetylenic alcohols or ethers.

24. The azeotrope-like compositions of claim 21 wherein said stabilizer is selected from the group consisting of secondary and tertiary amines, olefins and cycloolefins, alkylene oxides, sulfoxides, sulfones, nitrites, nitriles and acetylenic alcohols or ethers.

25. A method of cleaning a solid surface comprising treating said surface with an azeotrope-like composition of claim 1.

26. A method of cleaning a solid surface comprising treating said surface with an azeotrope-like composition of claim 3.

27. A method of cleaning a solid surface comprising treating said surface with an azeotrope-like composition of claim 6.

* * * * *